United States Patent [19]

Frick

[11] Patent Number: 4,783,659

[45] Date of Patent: Nov. 8, 1988

[54] ANALOG TRANSDUCER CIRCUIT WITH DIGITAL CONTROL

[75] Inventor: Roger L. Frick, Chanhassen, Minn.

[73] Assignee: Rosemount Inc., Eden Prairie, Minn.

[21] Appl. No.: 137,862

[22] Filed: Dec. 24, 1987

Related U.S. Application Data

[63] Continuation of Ser. No. 899,378, Aug. 22, 1986, abandoned.

[51] Int. Cl.[4] ..... G08C 19/10; G08C 19/12

[52] U.S. Cl. ..... 340/870.37; 340/870.04; 340/870.05; 340/870.17; 340/870.21; 364/557; 364/573

[58] Field of Search ..... 340/870.04, 870.05, 340/870.19, 870.21, 870.37, 870.39, 870.43, 310 R, 347 CC; 364/551, 557, 558, 571, 573, 579, 153, 154, 870.17

[56] References Cited

U.S. PATENT DOCUMENTS 3,646,538 2/1972 Frick .
4,001,813 1/1977 Kowswkowski .
4,129,863 12/1978 Gray et al. .
4,145,619 3/1979 Tseng .
4,494,183 1/1985 Bayer et al. .
4,519,253 5/1985 Frick .
4,567,466 1/1986 Bozarth et al. .
4,570,490 2/1986 Antonazzi .
4,604,566 8/1986 Sterling, Jr. et al. ..... 340/870.39

*Primary Examiner*—John W. Caldwell, Sr.
*Assistant Examiner*—Tyrone Queen
*Attorney, Agent, or Firm*—Kinney & Lange

[57] ABSTRACT

A two wire transmitter controls loop current as a function of a sensed parameter such as pressure or temperature using analog sensing and signal processing circuitry. Corrections, such as for zero, span, and linearity are provided in the form of analog correction signals by a digital circuit which includes nonvolatile memory, a microcomputer, and a digital-to-analog (D/A) converter. The microprocessor controls the D/A converter as a function of stored digital correction values to produce the analog correction signals used by the analog signal processing circuitry to control the magnitude of the loop current flowing through the two wire transmitter.

36 Claims, 7 Drawing Sheets

ANALOG TRANSDUCER CIRCUIT WITH DIGITAL CONTROL

This is a continuation of application Ser. No. 06/899,378, filed Aug. 22, 1986 (now abandoned).

BACKGROUND OF THE INVENTION

1. Field of the Invention

The present invention relates to transmitters.

2. Description of the Prior Art

Two wire transmitters have found widespread use in industrial process control systems. A two wire transmitter includes a pair of terminals which are connected in a current loop together with a power source and a load. The two wire transmitter is powered by the loop current flowing through the current loop, and varies the magnitude of the loop current as a function of a parameter P or condition which is sensed. Three and four wire transmitters have separate leads for supply current and output current.

Although a variety of operating ranges are possible, the most widely used two wire transmitter output varies from 4 to 20 mA as a function of the sensed parameter. It is typical with two wire transmitters to provide adjustment of the transmitter so that a minimum or zero value sensed corresponds to the minimum output (for example $I_z=4$ mA) and that the maximum parameter value to be sensed corresponds to the maximum output (for example 20 mA). This adjustability is typically provided by a zero potentiometer and a span potentiometer which provide variable resistances which can be set by the technician during calibration of the transmitter.

In order to provide a linear relationship between the loop current and the parameter, other adjustments may also be provided. For example, in a two wire transmitter having a variable reactance sensor driven by an oscillator (as shown for example in my previous U.S. Pat. Nos. 3,646,538 and 4,519,253) compensation for nonlinearity can be provided by a variable circuit component or by a component having a specially selected value determined during calibration.

In the case of a pressure sensing transmitter, it is important that the loop current is not affected by changes in temperature of the transmitter. Temperature compensation circuitry is typically provided, and often involves the use of additional resistance adjustments.

The use of resistance adjustments and other circuit components to provide zero, span, linearity and temperature compensation and calibration adds cost to the transmitter, particularly where extremely high resolution circuit components are needed. In addition, the added components themselves introduce potential sources of instability with varying temperature and with shock and vibration of the transmitter.

There is a continuing need for improved transmitters which eliminate the need for separate potentiometers or specially selected components, which provide an easier means for calibrating and, if necessary, recalibrating the transmitter; and which provide greater stability and increased resolution than that normally encountered using potentiometers and the like for calibration.

SUMMARY OF THE INVENTION

The present invention relates to a transmitter in which analog correction signals are provided based upon stored digital correction values. The transmitter includes means for producing an analog signal which varies as a function of the sensed parameter, and means for controlling magnitude of the loop current as a function of the analog signal and the analog correction signals. The digital correction values are stored and are converted to analog correction signals for use in controlling magnitude of the loop current.

In preferred embodiments, the transmitter is a two wire transmitter including digital-to-analog (D/A) converter means for converting digital inputs to analog correction signals. Digital computer means provide the digital inputs to the D/A converter means based upon the stored digital correction values.

In one embodiment, the D/A converter means produces pulse-width modulated output signals having duty cycles which are a function of the digital inputs. The pulse width modulated output signals are then converted to the analog correction signals, so that the analog correction signals have magnitudes which are a function of the stored digital correction values.

The present invention also preferably includes correction input means for providing input signals to the digital computer means. These input signals cause the digital computer means to change the digital correction values. As a result, the calibration of the transmitter can be performed quickly and easily with high precision. The correction input means can take various forms and typically requires minimal external connections to the transmitter.

DETAILED DESCRIPTION OF THE PREFERRED EMBODIMENTS

Figure 1:
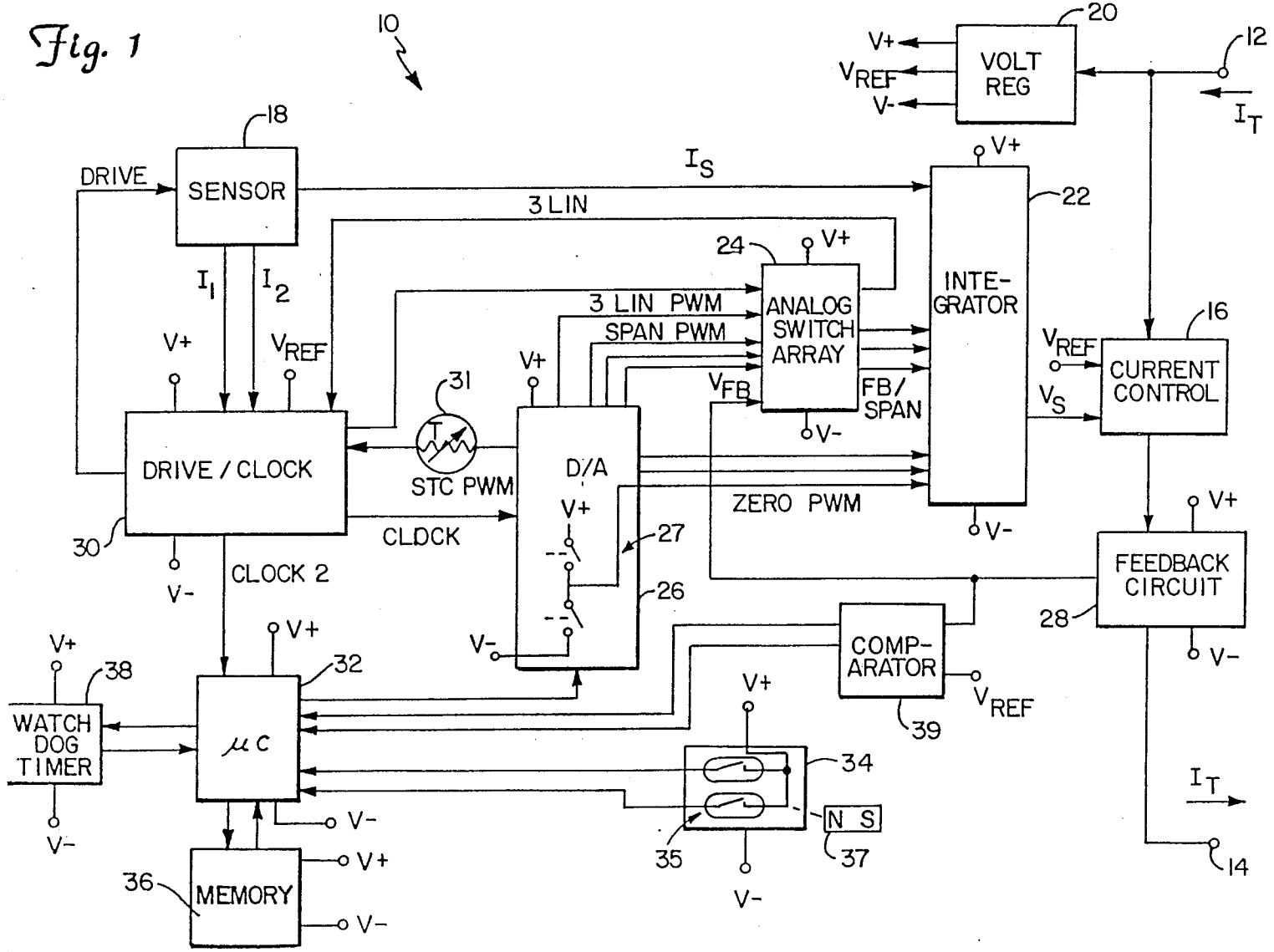
FIG. 1 is a block diagram of a preferred embodiment of the two wire transmitter of the present invention.

In FIG. 1, two wire transmitter 10 of the present invention has a pair of terminals 12 and 14 which are connected in a two wire current loop. The loop current $I_T$ enters through terminal 12 and exits through terminal 14. The magnitude of $I_T$ is controlled by current control 16 so that the magnitude of $I_T$ bears a predetermined relationship to a parameter sensed by sensor 18.

All of the electrical power used by transmitter 10 is derived from loop current $I_T$. Voltage regulator 20 establishes potentials V+, $V_{REF}$, and V−, which are used as supply and reference voltages by all of the remaining circuitry of transmitter 10.

Current control 16 controls current $I_T$ based upon a comparison of signal $V_s$ with reference voltage $V_{REF}$. $V_s$ is produced by integrator circuit 22 based upon a sensor signal from sensor 18, a pulse width modulated span adjusted feedback signal (FB/SPAN) from analog switch array 24, and a pulse width modulated zero signal (ZERO PWM) from digital-to-analog converter (D/A) 26. Each of the pulse width modulated outputs of D/A converter 26 is generated by a solid state switching circuit such as switching circuit 27 as shown in D/A converter 26. These signals are combined and integrated to provide a signal $V_s$ which is controlled by means of feedback through the current control to be substantially equal to $V_{REF}$ such that $I_T=I_z+KP$.

In this embodiment, sensor 18 is a variable reactance sensor which is driven by drive/clock circuit 30. In addition to the drive signal provided to sensor 18, drive/clock circuit 30 also provides a clock signal (CLOCK) to D/A converter 26 and a lower frequency clock signal (CLOCK2) to microcomputer 32. Microcomputer 32 receives input data from communication input circuit 34 and stored digital values from memory 36. Also associated with microcomputer 32 is watchdog timer 38. Transmitter 10 provides span, zero, temperature correction and third order linearity analog correction signals based upon digital correction values stored in memory 36. Microcomputer 32 controls D/A converter 26 as a function of the digital correction values by providing digital inputs to D/A converter 26.

In this embodiment, D/A converter 26 is a multichannel digital-to-analog converter which is driven by the CLOCK signal and which provides pulse width modulated outputs which have duty cycles based upon corresponding digital inputs received from microcomputer 32. In this particular embodiment, D/A converter 26 has eight output channels, three which are used for zero correction (ZEROPWM), three which are used for span (SPANPWM), one which is provided to drive/clock circuit 30 through thermistor network 31 to provide span temperature compensation (STCPWM) and one which is provided to analog switch array 24 to provide third order linearity corrections (3LINPWM).

The ZEROPWM outputs from D/A converter 26 are provided to integrator circuit 22 where they are integrated and combined to form a part of signal $V_s$.

The three SPANPWM outputs are provided to analog switch array 24, where they are combined with the feedback signal ($V_{FB}$) from feedback circuit 28. The result is three signals which represent the feedback signal pulse width modulated in accordance with the three SPANPWM outputs. These three combined feedback/span signals (FB/SPAN) are provided to integrator circuit 22.

The third order linearity pulse width modulated signal (3LINPWM) is combined with a signal from drive/clock circuit 30 by analog switch array 24 to produce a signal (3LIN) which is fed back to drive/clock circuit 30. The 3LIN signal is used to control the average frequency of the drive signal supplied to sensor 18 to achieve third order linearity correction of the sensor signal.

Communication input circuit 34 provides means by which a technician can communicate with microcomputer 32 to change the digital correction values stored in memory 36. Communication input circuit 34 can take a variety of forms, including magnetically actuated reed switches shown at 35 which are activated with a magnet 37 from outside of the transmitter by the technician. In this embodiment, no external calibration devices are required, since the magnetic signals can be sent directly through the housing of the transmitter. Communication input circuit 34 is, in another embodiment, a multi-terminal connector which connects an external device (such as the devices shown in FIGS. 3–5) with microcomputer 32. In still other embodiments, communication input circuit 34 is connected to the terminals 12 and 14 to sense encoded data which is superimposed on the loop current $I_T$. In that embodiment, communication input circuit 34 includes circuitry for converting the superimposed signals to a format which can be accepted by microcomputer 32.

A comparator circuit 39 compares $V_{FB}$ to $V_{REF}$ and provides signals to microcomputer 32 representative of zero and full scale current levels so that the microcomputer 32 can make automatic zero and span adjustments of the output current $I_T$.

The transmitter 10 shown in FIG. 1 eliminates the need for resistive potentiometers or other variable or precisely selected circuit components in order to provide calibration. Instead, the present invention uses microcomputer 32 to simply operate on D/A converter 24 to produce analog correction signals which are then used by the analog signal processing circuitry of two wire transmitter 10. This provides high accuracy in the corrections which are made, without the need for high precision electrical components. In addition, the use of digital values stored in memory 36 provides much greater stability than would be achieved using conventional potentiometers.

Transmitter 10 of the present invention also has significant advantages over approaches where the signal is converted from analog to digital, is corrected, and then is converted back to an analog signal. First, the output is not subject to aliasing errors because the analog sensor signal is never sampled. Second, the output of transmitter 10 is continuous and does not have resolution limits due to quantization. Third, microcomputer 32 is not involved in real time measurement and therefore can be run at a very low frequency. This reduces the power requirements of microcomputer 32, which is an important consideration in low power, two wire transmitter circuitry. Fourth, because microcomputer 32 is not involved in the real time measurement process, but simply provides digital values to D/A converter 26 based upon stored correction values in memory 36, it can be used for other tasks such as communications. The microcomputer 32 can thus calculate digital values provided to the D/A converter at a low speed or rate compatible with low power consumption while the analog output can provide the output at a faster rate. Since the microcomputer 32 does not perform real-time calculation of the output, the rate at which the microcomputer 32 updates the D/A converter 26 does not limit the speed of the output. Also, since the sensor current $I_s$ is not sampled by the processor, aliasing (also known as heterodyning or beating) between the sensed parameter and the sampling rate are avoided. This will be discussed further in relation to the embodiment shown in FIG. 6.

Figure 2A:
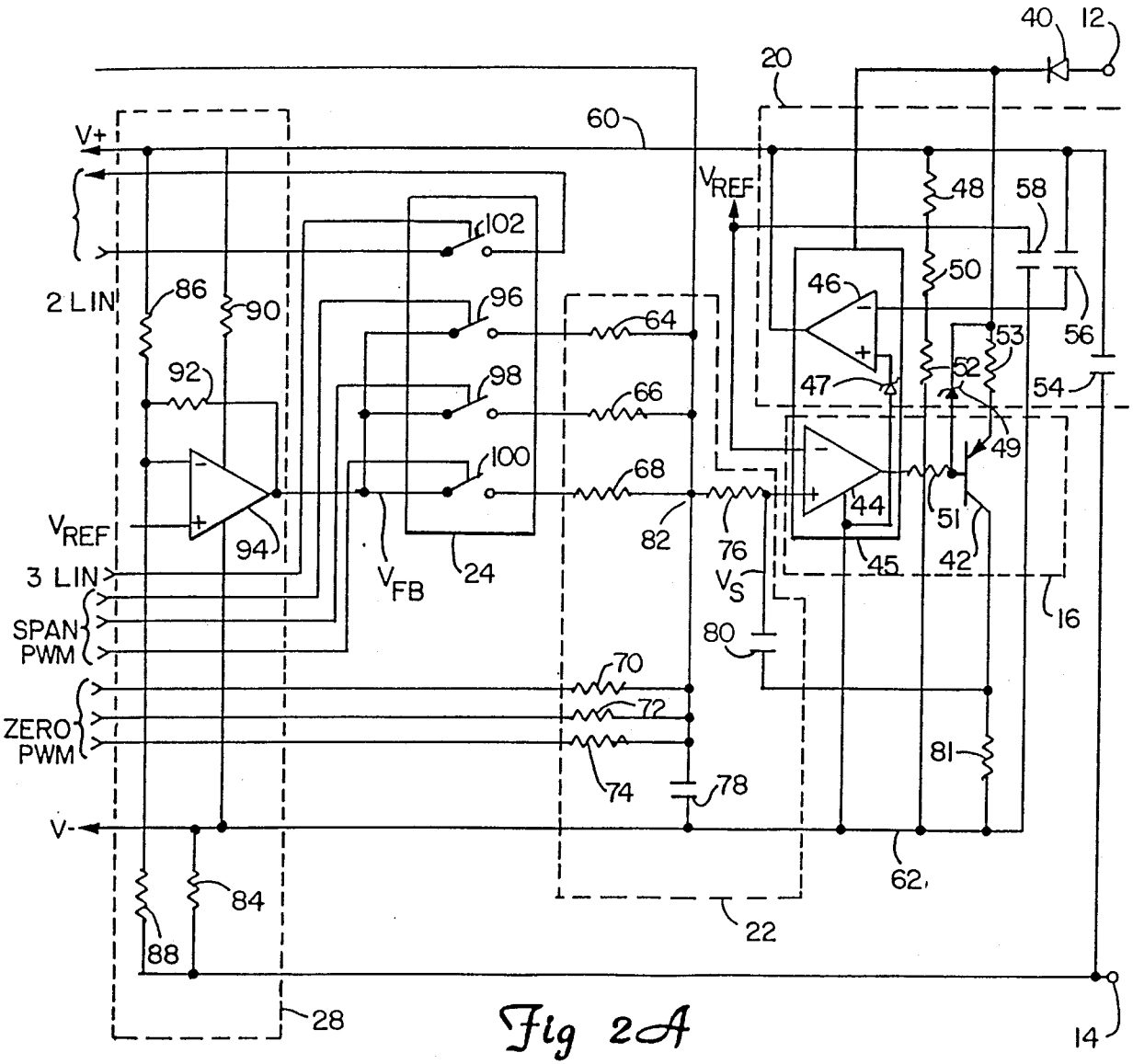
FIGS. 2A and 2B are an electrical schematic diagram of one embodiment of the two wire transmitter of FIG. 1.
Figure 2B:
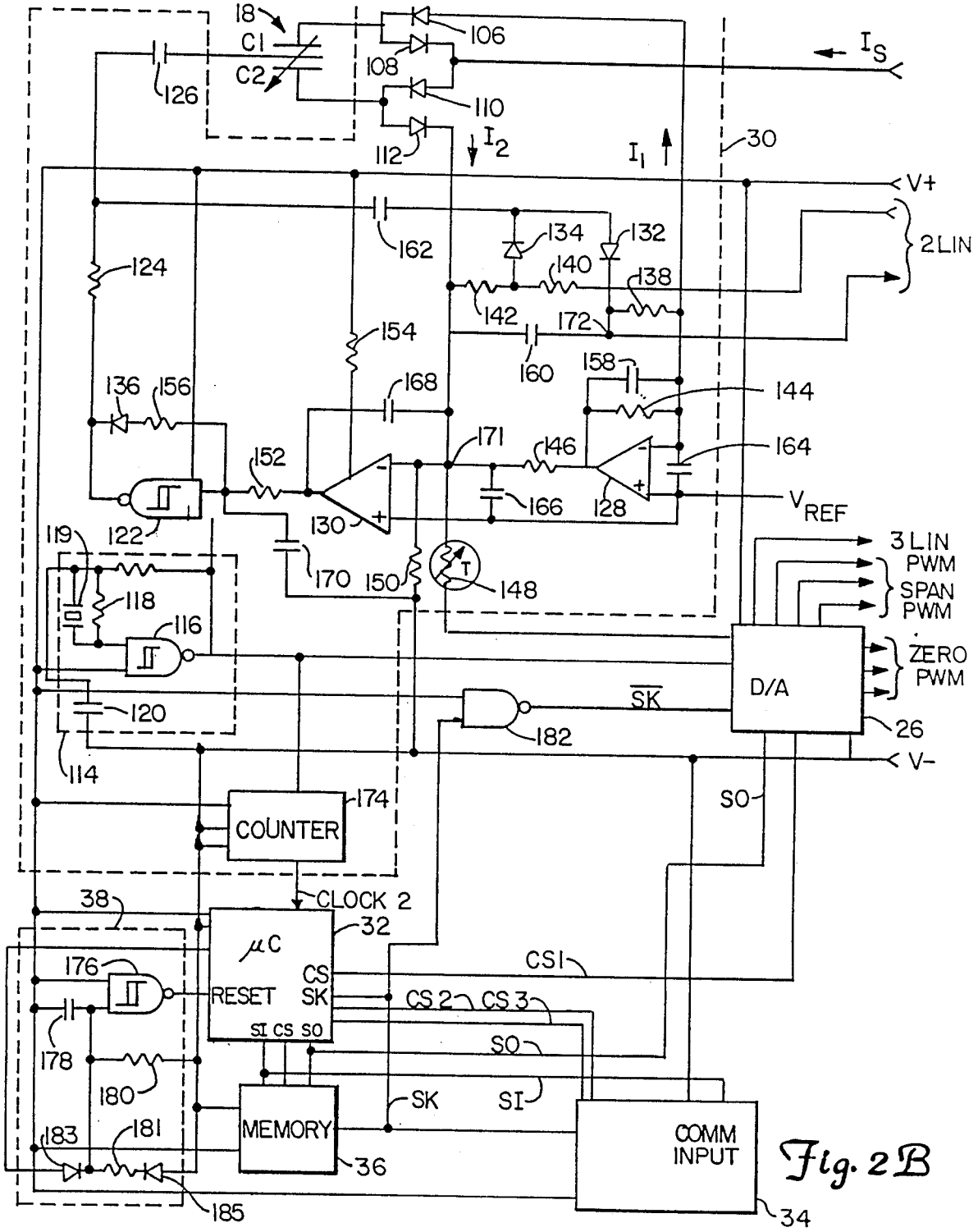

FIGS. 2A and 2B is an electrical schematic diagram showing the transmitter 10 of FIG. 1 in further detail. Current control 16 is formed by diode 40, PNP transistor 42, and operational amplifier (op amp) 44. Diode 40 has its anode connected to terminal 12 and its cathode coupled to the emitter of transistor 42. Diode 40 provides reverse polarity protection in the event that the voltage across terminals 12 and 14 is inadvertently reversed. As shown in FIG. 1, terminal 12 is the more positive terminal (designated with a "+") and terminal 14 is the more negative terminal (designated by a "−"), so that the flow of loop current $I_T$ is into terminal 12 and out of terminal 14.

The current flowing through current control transistor 42 is controlled by op amp 44, which is part of an LM10 integrated circuit 45 manufactured by National Semiconductor. Op amp 44 receives a reference voltage $V_{REF}$ at its inverting (−) input and the variable signal $V_s$ at it noninverting (+) input. The output of op amp 44 drives the base of transistor 42 to achieve a balance condition in which $V_s$ and $V_{REF}$ are substantially equal. Zener diode 49 and resistors 51 and 53 provide current limiting of the output stage to prevent excess current output and prevent oscillations.

Voltage regulator 20 includes operational amplifier 46, band-gap circuit 47, resistors 48, 50 and 52 and capacitors 54, 56, and 58. Comparator 46 and band gap reference 47 are part of the LM10 integrated circuit 45. Voltage regulator 20 establishes a constant potential between line 60 and line 62. As shown in FIGS. 1 and 2, line 60 is designated as V+and line 62 as V−. The potential between lines 60 and 62 is, in one embodiment, five volts. Resistors 48, 50 and 52 form a voltage divider between lines 60 and 62 to provide the reference voltage $V_{REF}$ and to provide a feedback voltage to operational amplifier 46. Capacitors 54, 56 and 58 are bypass capacitors which help stablize the operation of voltage regulator 20.

Integrator circuit 22 includes resistors 64, 66, 68, 70, 72, 74 and 76 and capacitor 78. Integrating capacitor 80 and resistor 81 provide A.C. feedback to stabilize the loop. The sensor current $I_s$ is summed, at node 82, with three span adjusted feedback currents from analog switch 24 and three pulse width modulated zero currents from D/A converter 26. The summed current is filtered by capacitor 178 and then provided to the RC integrator formed by resistors 76 and 81 and capacitor 80 to produce voltage $V_S$ at the noninverting input of op amp 44.

Feedback circuit 28 includes resistors 84, 86, 88, 90 and 92 and op amp 94. Resistor 84 is connected between line 62 and terminal 14, and acts as the current feedback resistor. The voltage established across resistor 84 is converted by resistors 86, 88, 90 and 92 and op amp 94 to produce a voltage $V_{FB}$ which is supplied to input terminals of analog switches 96, 98, and 100 of analog switch array 24. In the embodiment shown in FIG. 1, analog switch array 24 is preferably a type CD4066B integrated circuit analog switch array made by RCA having four analog switches 96, 98, 100 and 102.

The control terminals of switches 96, 98 and 100 are connected to outputs of D/A converter 26 which provide individual pulse-width-modulated span signals. The outputs of switches 96, 98 and 100 are connected through resistors 64, 66 and 68, respectively, to summing node 82. The results are three individual feedback currents which are a function of a feedback voltage $V_{FB}$ modulated by the individual pulse width modulated span signals.

In a preferred embodiment of the present invention, D/A converter 26 is a type uA9706 multi-channel digital-to-analog converter made by Fairchild which produces pulse width modulated outputs. Each output channel has six bits resolution. To provide very high span and zero resolution, three weighted outputs are used for span and three weighted outputs for zero. The weighting of the channel is a $2^6$ relationship (or 64 to 1). Three channels thus provide 18 bit resolution. The weighting of the channels is set by selection of the resistances of resistors 64, 66, 6S, 70, 72 and 74. The three pulse width modulated span signal are individually controlled, as are the three pulse width modulated zero signals.

In the embodiment shown in FIGS. 2A and 2B, sensor 18 is an AC reactance type differential pressure sensor cell, which has a pair of capacitors C1 and C2, at least one of which is variable in response to a parameter such as pressure. A drive signal is received at the center plate of capacitors C1 and C2, and a rectifying circuit formed by diodes 106, 108, 110, and 112 derive a sensor signal $I_S$ which is supplied to node 82 of integrator circuit 22 and currents $I_1$ and $I_2$ which are used by drive/clock circuit 30 in controlling the drive signal supplied to capacitors C1 and C2. Drive/clock circuit 30 maintains the drive to sensor 18 so that the product of the average frequency $\bar{f}$, the peak to peak voltage $V_{pp}$, and the sum of the capacitances of C1 and C2 are constant:

$$fV_{pp}(C_1+C_2)=K \qquad \text{Eq. 1}$$

By maintaining this drive signal relationship, the sensor current $I_s$ has the following relationship:

Equation 2:

$$I_S \alpha (C1-C2)/(C1+C2) \qquad \text{Eq. 2}$$

Drive/clock circuit 30 includes a system clock 114 formed by NAND Schmitt trigger gate 116, resistor 188, crystal 119 and capacitor 120 which provides clock signals for D/A converter 26, microcomputer 32, as well as for drive/clock circuit 30. The output of NAND gate 116 is supplied to one input of Schmitt trigger NAND gate 122. The output of gate 122 is connected through resistor 124 and capacitor 126 to the center plate of sensor capacitors C1 and C2. The output of gate 122, therefore, represents the drive signal which is controlled in accordance with Eq. 1.

In the embodiment of the present invention shown in FIGS. 2A and 2B, the average frequency of the drive signal is controlled by selectively dropping out pulses from the clock signal supplied by system clock 114 to gate 122. This selective dropping out of signal pulses controlled by the control signal supplied to the other input of gate 122. This control signal is provided by the circuitry which includes op amps 128 and 130, diodes 132, 134, and 136, resistors 138, 140, 142, 144, 146, 150, 152, 154, and 156, and capacitors 158, 160, 162, 164, 166, 168, and 170 and temperature sensitive resistor network 148.

Current $I_1$ which flows through diode 106 is fed to the minus input of op amp 128. Resistors 144 and 146 act in conjunction with op amp 128 to convert current $I_1$ to a current which is flowing into node 171, which is connected to the—input of op amp 130. This current is summed with the current $I_2$ from diode 112 at node 171. As a result, node 171 has a potential which is proportional to C1+C2. The voltage at node 171 is compared to $V_{REF}$ by op amp 130. The output of op amp 130 controls gate 122 to determine whether a particular clock pulse from clock circuit 114 will pass through gate 122 to sensor 18.

Span temperature compensation is provided by applying the desired PWM voltage signal to temperature sensitive resistor network 148. This provides a correction current to node 171 at op-amp 130 which controls sensor excitation.

Third degree linearization is provided. A signal from node 172 (which is the junction of resistor 138 and capacitor 160) is supplied to the input terminal of analog switch 102. The state of switch 102 is controlled by an output from D/A converter 26, which represents a pulse width modulated signal having a duty cycle representative of a desired amount of third degree linearization. The output of switch 102 is fed back through resistors 140 and 142 to node 171.

In transmitter 10 shown in FIG. 1, D/A converter 26, microcomputer 32, and the drive for sensor 18 all are derived from a common clock signal produced by system clock 114. This eliminates possible alias or beat frequencies which could occur if microcomputer 32 were operating on a separate clock from that of the drive circuit. The system clock signal is provided directly to the clock input of D/A converter 126. In the case of microcomputer 32, however, the system clock is divided by counter 174 to produce a lower frequency clock signal (CLOCK2) to the microcomputer 32. One of the advantages of the transmitter of the present invention is that microcomputer 32 does not perform computations or control functions in real time, and therefore the CLOCK2 signal can be relatively low frequency. This reduces the power requirements of microcomputer 32, which is an important consideration in a two wire transmitter which is powered solely by the loop current $I_T$. Microcomputer 32 preferably comprises a type COP326C made by National Semiconductor.

Watchdog timer 38 is formed by Schmitt NAND gate 176, diodes 183 and 185, capacitor 178, and resistors 180 and 181. Watchdog timer 38 resets microcomputer 32 if it does not receive a signal from microcomputer 32 within a predetermined time period. In addition, watchdog timer 38 resets microcomputer 32 when the power is first turned on.

Microcomputer 32 receives digital correction values from non-volatile memory 36 over the serial input (SI) line and provides digital values to D/A converter 26 over its serial output (SO) line. Inverter 182 provides compatability between microcomputer 32 and D/A convertor 26. Microcomputer 32 couples chip select (CS, CS1, CS2, CS3) signals to access D/A 26, memory 36, and communication circuit 34.

In addition, microcomputer 32 receives input values over the serial input line from communication input 34 (which in this embodiment is a multi-pin connector), and writes new digital correction values into memory 36 over the serial output line.

Use of serial communication between microcomputer 32, D/A convertor 26, communication input 34 and nonvolatile memory 36 minimizes pin counts of the individual components. Since speed is not a significant consideration in the operation of microcomputer 32, the reduced pin count and simplification of connections among the components provided by serial data transmission is an important consideration.

Although transmitter 10 of the present invention offers significant advantages even if adjustment by a technician of correction factors such as span and zero is not provided (i.e. the digital values stored in memory 36 are factory set), it is desirable to have a low cost device which would allow the technician to adjust and configure two wire transmitter 10 in the field. Previously available hand held terminals used with conventional two wire transmitters typically have been bulky and expensive.

Figure 3:
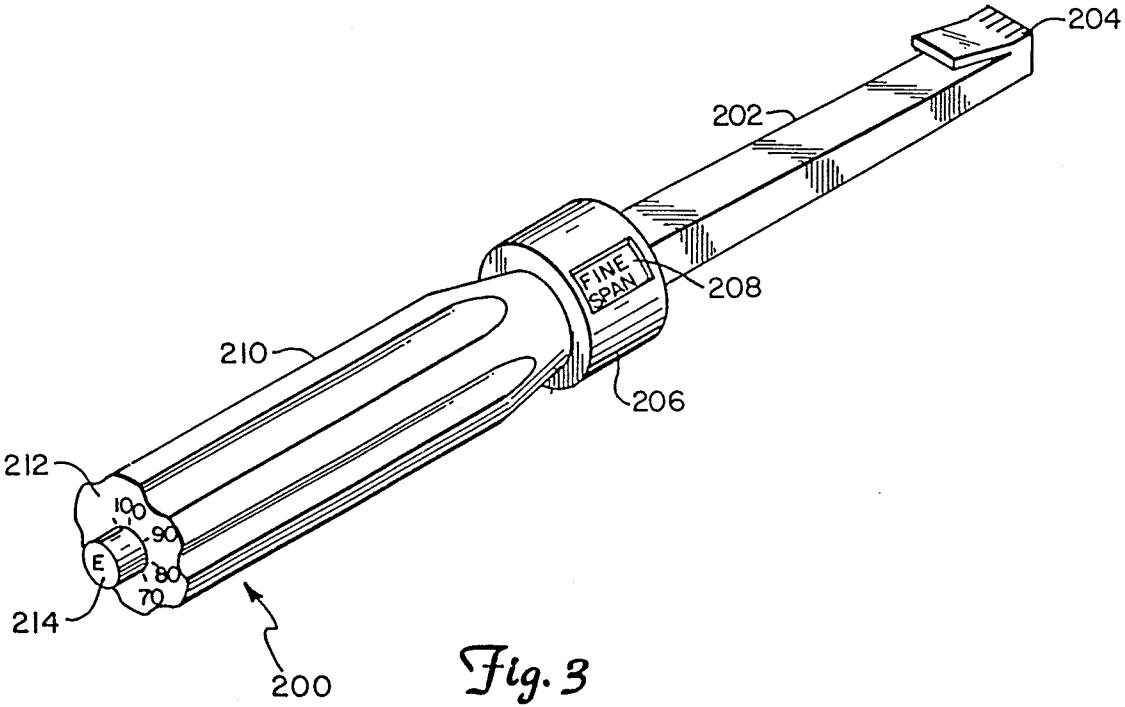
FIG. 3 is a perspective view of an "electronic screwdriver" input device for the two wire transmitter of the present invention.
Figure 4:
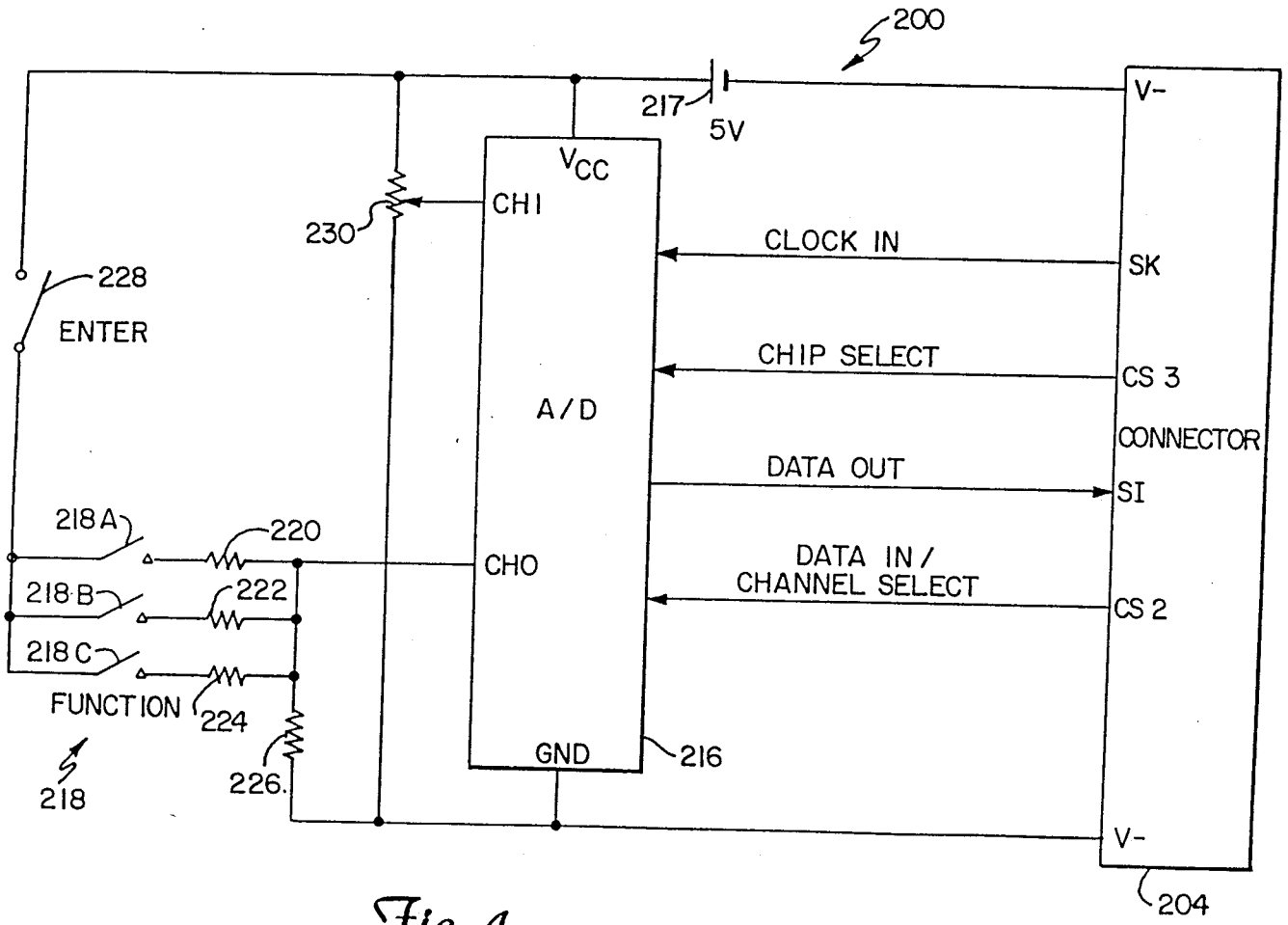
FIG. 4 is an electrical schematic diagram of the electronic screwdriver input device of FIG. 3.

FIGS. 3 and 4 show a simple device that functions in a manner similar to the potentiometer controls that are familiar to instrument technicians, yet provides digital values to microcomputer 32. Electronic screwdriver 200 has a shank 202 of a electrically nonconductive material having a six contact telephone type connector 204 at its distal end. Rotatable function selecting ring 206 has a window 208 which is aligned with one of eight different functions which can be selected by the technician. The screwdriver body 210 is rotatable about the central axis. At its end, body 210 has a calibration scale 212 which runs from zero to 100 percent. Scale 212 represents the percentage of maximum calibration value being selected by the technician. Also located at the end of body 210 is a push button 214 which is depressed to enter data.

As shown in FIG. 4, electronic screwdriver 200 includes a two channel, serial out, eight bit analog-to-digital (A/D) converter 216 (such as a part number COP432 made by National Semiconductor) which is connected to six contact connector 204 so that when connector 204 is connected to communication input 34 of transmitter 14, A/D converter 216 is powered by battery 217 and communicates with microcomputer 32.

Function selection ring 206 is coupled to an eight position switch 218 which contains three switch contacts 218A–218C connected through resistors 220, 222, and 224 to channel CH0 of A/D converter 216. Resistor 226 is connected between the CH0 input and ground. Depending on the particular setting of selector ring 206, one or more of the switch contacts 218A–31SC of switch 218 will be closed. When the enter button 214 is pushed, it closes pushbutton switch 228, which provides +5 volts to switch 218. The voltage appearing at the CH0 input of A/D converter 216 will depend on the particular switch contacts 218A–218C which are closed. Eight different voltage levels can appear at CH0 depending on the position of function selection ring 206.

Input channel CH1 of A/D converter 216 is connected to a single turn potentiometer 230. The rotation of body 210 changes the setting of potentiometer 230, and thus the voltage appearing at CH1.

To use electronic screwdriver 200, the operator inserts connector 204 into the mating female connector of communication input 34. The technician then selects the function desired by rotating the function selection ring 206 until the desired function appears in window 208. In the embodiment shown in FIG. 4, the functions which can be selected include COARSE, MEDIUM and FINE ZERO; COARSE, MEDIUM and FINE SPAN; SAVE; and OFF.

Once the technician has selected the desired function, the enter button 214 is depressed. This closes pushbutton switch 228, which allows A/D converter 216 to read the voltage at CH0. Microcomputer 32 reads CH0 and selects the appropriate internal adjustment register in its on-board random access memory (RAM).

The technician then adjusts the calibration value by rotating body 210 until a cursor on button 214 is lined with the desired percentage on scale 212. As body 210 is rotated, data is continuously being provided, in the form of eight bit readings from channel CH1 to the selected channel of the D/A converter 26 and the on-board RAM of microcomputer 32. When the adjustment is completed, the technician can select another function by changing the setting of function select ring 206 and again pressing the enter button 214. The technician then again performs the adjust function by rotating body 210 to the desired position and data is stored in the appropriate register by microcomputer 32.

Up to this point, the data which has been entered is stored only in the on-board memory of microcomputer 32. To save that data in nonvolatile memory 36, the technician places the function select ring 206 to the "Save" position and pushes the enter button 214. This signals microcomputer 32 that it should write the data stored in its internal adjustment registers into the appropriate locations of nonvolatile memory 36. At this point, the operation is completed, and the electronic screwdriver 200 is disconnected from communication input 34.

In another embodiment, the OFF function is replaced by a FACTORY CALIBRATE function on function selector ring 206. In this function, the operator can select the original factory calibration simply by moving the function selection ring to the FACTORY CALIBRATE position and pressing the enter button 214. This allows the technician to always return the unit to factory calibration regardless of the field adjustments which have been made to calibration.

In some cases, it is desirable to restrict the type of adjustments to be made by a particular technician—for example, certain technicians may be allowed to adjust both zero and span, while other technicians are permitted to adjust only zero. This can be achieved by issuing different electronic screwdrivers to different technicians, some which have the span function settings while others do not.

Figure 5:
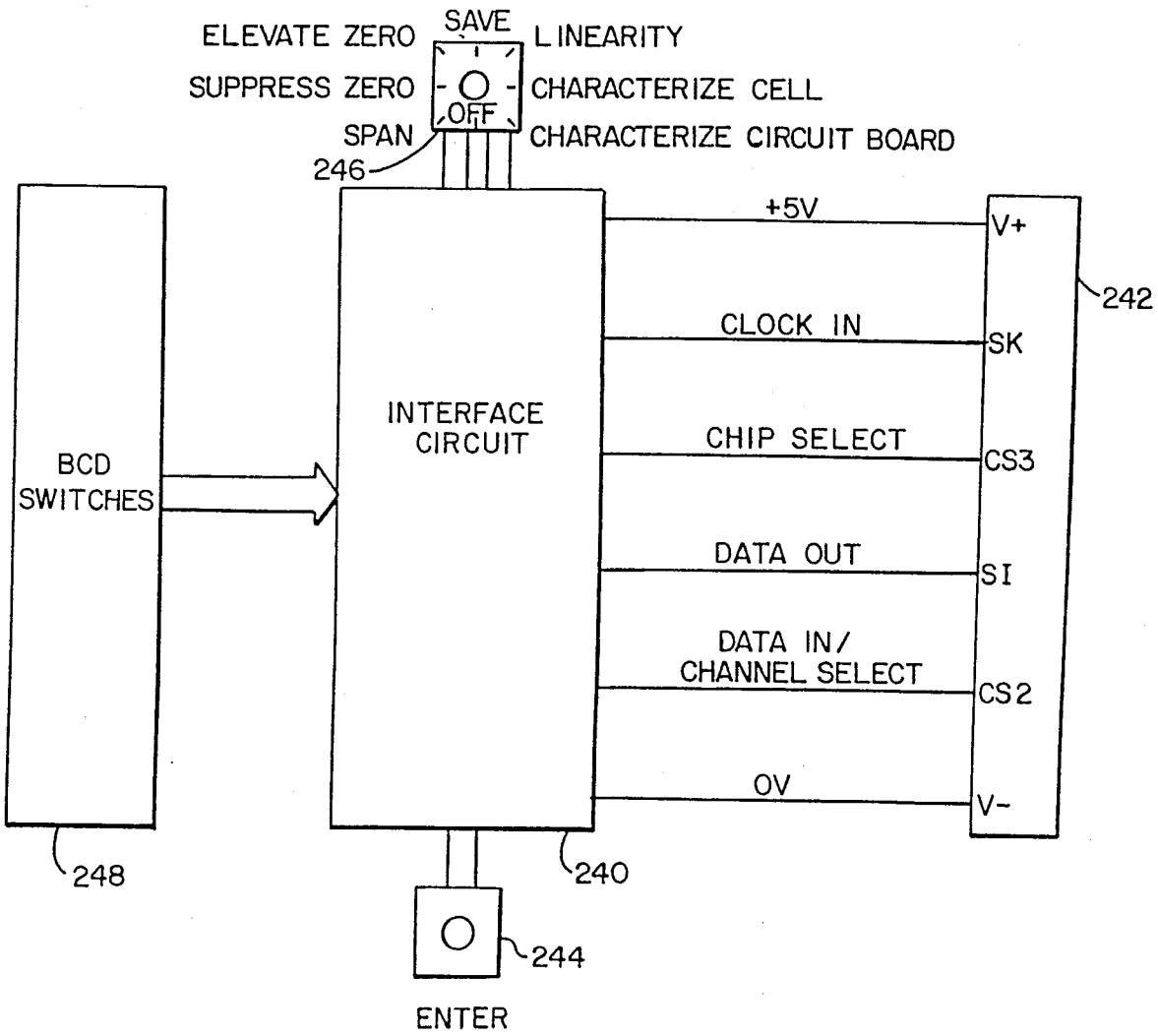
FIG. 5 is an electrical schematic diagram of another embodiment of an input device for communication with the two wire transmitter of the present invention.

FIG. 5 shows another embodiment of an input device which operates in a manner similar to the electronic screwdriver of FIGS. 3 and 4, but provides more complex functions to be performed. In this embodiment, a digital interface circuit 240 communicates with microcomputer 32 through a multi-terminal connector 242. The inputs to interface circuit 240 include an enter push button switch 244, function select switch 246, and a digital value input which is preferably an array of BCD or HEX encoded switches used for entering numerical values.

The functions provided by function select switch 246 include "ELEVATE ZERO", "SUPRESSED ZERO", "SPAN", "LINEARITY", "CHARACTERIZE CELL", "CHARACTERIZE CIRCUIT BOARD", "SAVE" and "OFF". To calibrate, the technician sets the function switch 246 to, for example, "SPAN" and enters the desired span in percent of maximum span by setting a value on digital switches 24S. The value is entered into microcomputer 32 by depressing enter switch 244. The data which has been entered can be saved in nonvolatile memory 36 by moving function switch 246 to the save position and again depressing the enter button 244.

To repair transmitter 10, six-character codes from the cell and circuit board assembly are entered using the CHARACTERIZE CELL and CHARACTERIZE CIRCUIT BOARD functions. This permits the microcomputer 32 to produce and store appropriate calibration values to match the cell (i.e. the sensor) to the circuit board.

Figure 6:
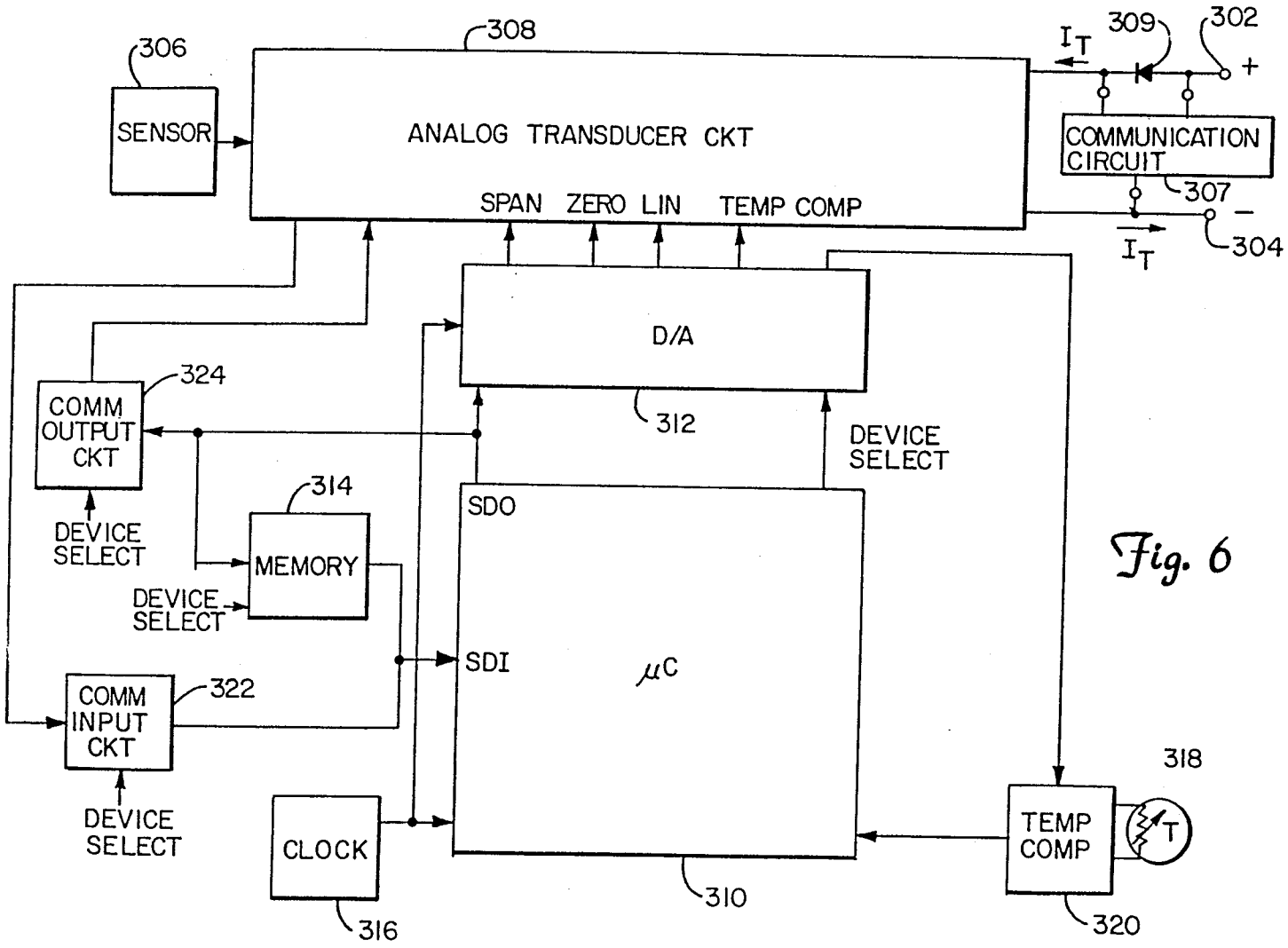
FIG. 6 is a block diagram of another embodiment of the two wire transmitter of the present invention.

FIG. 6 shows a block diagram of another embodiment of the two wire transmitter of the present invention. As in the embodiment shown in FIG. 1, two wire transmitter 300 of FIG. 6 controls the loop current $I_T$ flowing through terminals 302 and 304 as a function of a parameter sensed by a sensor 306. Analog transducer circuitry 308 controls the magnitude of loop current $I_T$ as a function of a sensor signal from sensor 306, together with span, zero, linearity, and temperature compensation signals provided by microcomputer 310 through digital-to-analog converter 312. The analog correction values are based upon stored digital correction values which microcomputer 310 obtains from memory 314. In the embodiment shown in FIG. 6, clock 316 provides clock signals to microcomputer 310 as well as D/A converter 312. In this preferred embodiment, the outputs of D/A converter 312 are pulse width modulated signals having duty cycles which are determined by digital values provided to D/A converter 312 by microcomputer 310.

Transmitter 300 includes a temperature sensing resistor 318. Temperature compensation circuit 320 senses the voltage on temperature sensing resistor 18 and compares that voltage to one output channel of D/A converter 312. The output based on this comparison is provided to microcomputer 310. By changing the digital value provided to D/A converter 312, microcomputer 310 can determine the digital value which causes the output of circuit 320 to change state. That digital value is representative of the sensed temperature. Microcomputer 310 provides appropriate digital values to A/D converter 312 based on the sensed temperature to temperature compensate the analog transducer circuitry 308. This includes a temperature compensation signal output from A/D converter 312, and may also involve adjustment of some or all of the other outputs of A/D converter 308. The constants for this temperature compensation are stored in nonvolatile memory 314.

Transmitter 300 includes provision for communication between microcomputer 310 and a remote terminal over the two wires connected to terminals 302 and 304. This communication is achieved by superimposing serial communication signals on the loop current $I_T$ flowing through transmitter 300. Incoming communications are detected by communication input detector 322, which converts the fluctuations in the loop signal into serial data supplied to the serial data in port of microcomputer 310. Outbound communications from microcomputer 310 are supplied through communication output circuit 324, which drives the current controller of the analog transducer circuitry 308 to superimpose serial communication signals on the loop current.

Preferably, the remote terminal 307 with which microcomputer 310 communicates is capable of measuring loop current as well as communicating. This facilitates calibration, since microcomputer 310 otherwise does not have available the value of the loop current at any given point in time. A diode 309 in the loop can provide a third terminal to the remote terminal 307 for measuring loop current. Current can thus be measured without interrupting the loop current. If desired, this three terminal connection can provide power to remote terminal 307 while still allowing it to monitor transmitter output current.

In conclusion, the present invention is a two wire transmitter which is similar in size, cost, and performance to totally analog transmitter circuits. The addition of digital circuitry and a microcomputer achieves high resolution calibration, increases flexibility and ease in the selection of calibration values and the recalibration of the transmitter, and provides greater stability than is achieved using adjustable analog devices (such as adjustable potentiometers and variable capacitances) in order to achieve calibration of the transmitter circuit.

Although the present invention has been described with reference to preferred embodiments, workers skilled in the art will recognize that changes may be made in form and detail without departing from the spirit and scope of the invention.

What is claimed is:

1. A transmitter for providing an analog output signal representative of a sensed parameter and representative of an input adjustment signal, comprising:

digital means coupled to receive the input adjustment signal for calculating and providing a control signal representative of an adjustment to the analog output signal;

analog means responsive to the sensed parameter for providing the analog output signal as a continuous function of the sensed parameter; and control means coupled to the analog means and controlled by the control signal for controlling adjustment of the analog output signal by the analog means such that continuity of the analog output signal is undisturbed by calculation in the digital means.

2. The transmitter of claim 1 wherein the digital means calculates the control signal at a first rate and the analog means provides the output signal at a second rate independent of the first rate.

3. The transmitter of claim 2 wherein the output signal is free of aliasing between variation of the sensed parameter and the first rate.

4. The transmitter of claim 1 wherein the control means comprises switch means controlled by the control signal for controlling the analog means.

5. The transmitter of claim 4 wherein the control means comprises a digital-to-analog converter coupled to control actuation of the switch means.

6. The transmitter of claim 5 wherein the digital-to-analog converter provides a pulse width modulated control signal to the switch means.

7. The transmitter of claim 6 wherein the pulse width modulated control signal is modulated at a high enough modulation rate such that an output rate of the analog output signal is not limited by the modulation rate.

8. The transmitter of claim 7 wherein the analog means comprises integrator means coupled to the switch means for damping the analog output signal.

9. The transmitter of claim 8 wherein the control signal is representative of a desired span adjustment.

10. The transmitter of claim 8 wherein the control signal is representative of a desired zero adjustment.

11. The transmitter of claim 8 wherein the transmitter is coupled to an energized by a loop.

12. The transmitter of claim 8 wherein the analog output signal is a 4 to 20 milliampere current.

13. The transmitter of claim 8 wherein the control signal is representative of a desired linearity adjustment.

14. The transmitter of claim 9 and further including temperature response means coupled to the control means for temperature compensation of the span adjustment.

15. A transmitter for providing an analog output signal representative of a sensed parameter and representative of an input signal for controlling transmitter adjustment, comprising:

digital means coupled to receive the input signal for calculating and providing a digital control signal representative of the adjustment;

converter means coupled to the digital means for converting the digital control signal to a converter signal having a duty cycle representative of the adjustment;

switch means coupled to the converter means for controlling switching as a function of the converter signal;

sensor means responsive to the sensed parameter for providing an analog sensor signal to the switch means; and output means coupled to the switch means for providing the analog output signal as a function of the analog sensor signal and the converter signal.

16. The transmitter of claim 15 and further comprising:

integrator means coupled to the switching means for damping the analog output signal.

17. The transmitter of claim 16 wherein the transmitter means further comprises:

feedback means coupled to the output means for providing a feedback signal representative of the analog output signal to the output means such that the analog output signal is stabilized.

18. The transmitter of claim 17 wherein the sensor means comprise a capacitive pressure sensor.

19. The transmitter of claim 17 wherein the digital means comprises a serial data input for receiving a transmitter adjustment.

20. The transmitter of claim 19 wherein the digital means further comprises a non-volatile memory for storing a transmitter adjustment.

21. A two wire transmitter for connection in a current loop to control a loop current flowing in the loop as a function of a sensed parameter, the transmitter being powered by the loop current, the transmitter comprising:

sensing means responsive to the sensed parameter for producing an analog sensor signal which varies as a function of the sensed parameter;

storage means for storing digital correction values; converting means coupled to the storage means for converting the digital correction values to analog correction signals; and analog output means coupled to the sensing means and the converting means for controlling the magnitude of the loop current as a function of the analog sensor signal and the analog correction signals.

22. The two wire transmitter of claim 21 wherein the converting means comprises:

digital-to-analog (D/A) converter means for converting digital inputs to analog correction signals; and digital computer means coupled to the storage means and the D/A converter means for providing the digital inputs to the D/A converter means based upon the digital correction values.

23. The two wire transmitter of claim 22 wherein the D/A converter means produces pulse width modulated output signals having duty cycles which are a function of the digital inputs.

24. The two wire transmitter of claim 23 wherein the converting means further comprises:

means coupled to the D/A converter means for converting the pulse width modulated output signals to the analog correction signals having magnitudes which are a function of the digital correction values.

25. The two wire transmitter of claim 24 wherein the means for converting the pulse width modulated output signals comprises integrator means for integrating the pulse width modulated output signals.

26. The two wire transmitter of claim 23 wherein the pulse width modulated output signals include span and zero signals for providing span and zero corrections, respectively.

27. The two wire transmitter of claim 26 and further comprising:

means for providing an analog feedback signal which is a function of the loop current; and wherein the converting means further comprises:

means for producing, as one of the analog correction signals, a span corrected feedback signal which is a function of the analog feedback signal and the span signal.

28. The two wire transmitter of claim 22 and further comprising:

correction input means for providing input signals to the digital computer means to cause the digital computer means to change the digital correction values stored.

29. The two wire transmitter of claim 21 wherein the sensing means for producing an analog sensor signal comprises:

variable reactance sensor means having a reactance which varies responsive to the parameter;

drive means coupled to the variable reactance sensor means for providing a time varying drive signal to the variable reactance sensor means;

means coupled to the variable reactance sensor means for deriving the analog sensor signal from the variable reactance sensor means; and drive control means coupled to the drive means for controlling the drive means to cause the analog sensor signal to have a predetermined relationship to the parameter.

30. The two wire transmitter of claim 29 wherein the analog correction signals include at least one linearization signal for correcting nonlinearity of the analog sensor signal with respect to the parameter, and wherein the drive control means is responsive to the linearization signal.

31. The two wire transmitter of claim 29 wherein the drive means comprises:

clock means for providing a clock signal having a predetermined frequency; and means coupled to the clock means and the variable reactance sensor means for selectively providing clock pulses of the clock signal to the variable reactance sensor means as the drive signal as a function of a control signal from the drive control means.

32. The two wire transmitter of claim 31 wherein the converting means comprises:

pulse width modulation digital-to-analog (D/A) converter means for producing pulse width modulated output signals having duty cycles which are a function of digital inputs, the D/A converter means having a clock input for receiving the clock signal;

means coupled to the D/A converter means for converting the pulse width modulated output signals to the analog correction signals; and digital computer means coupled to the D/A converter means for providing the digital inputs as a function of the digital correction values, the digital computer means operating at a frequency determined by the clock signal.

33. The two wire transmitter of claim 28 wherein the correction input means comprises an analog-to-digital converter providing the input signals and a potentiometer coupled to the analog-to-digital converter for providing an analog signal thereto.

34. The two wire transmitter of claim 33 wherein the correction input means adjusts span.

35. The two wire transmitter of claim 28 wherein the correction input means comprises current sensing means for sensing the loop current.

36. A transmitter for providing an analog output signal representative of a sensed parameter and corrected as a function of digital transmitter adjustment values; the transmitter comprising:

sensing means responsive to the sensed parameter for producing an analog sensor signal which varies as a function of the sensed parameter;

converting means responsive to the digital transmitter adjustment values for converting the digital transmitter adjustment values to analog correction signals; and analog output means coupled to the sensing means and the converting means for providing the analog output signal as a function of the analog sensor signal and the analog correction signals.

* * * * *

UNITED STATES PATENT AND TRADEMARK OFFICE

CERTIFICATE OF CORRECTION

PATENT NO. : 4,783,659

DATED : November 8, 1988

INVENTOR(S) : Roger L. Frick

It is certified that error appears in the above-identified patent and that said Letters Patent is hereby corrected as shown below:

Col. 6, Line 17, (in Eq. 1), delete "f", and insert --$\bar{f}$--.

Col. 6, Line 27, delete "188", and insert --118--

Col. 8, Line 1, delete "a" (second occurrence), and insert --an--.

Col. 8, Lin 28, delete "218A-31SC", and insert --218A-218C--.

Col. 9, Line 47, delete "24S", and insert --248--.

Col. 11, Line 48, delete "an", and insert --and--

UNITED STATES PATENT AND TRADEMARK OFFICE

CERTIFICATE OF CORRECTION

PATENT NO. : 4,783,659

DATED : November 8, 1988

INVENTOR(S) : Roger L. Frick

It is certified that error appears in the above-identified patent and that said Letters Patent is hereby corrected as shown below:

Col. 12, Line 41, After "controlling", delete "the".

Signed and Sealed this

Eighth Day of August, 1989

*Attest:*

DONALD J. QUIGG

*Attesting Officer*

*Commissioner of Patents and Trademarks*